US007009572B1

(12) United States Patent
Homer et al.

(10) Patent No.: US 7,009,572 B1
(45) Date of Patent: Mar. 7, 2006

(54) TAPERED SLOT ANTENNA

(75) Inventors: Robert S. Homer, San Diego, CA (US); Bruce Calder, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/932,650

(22) Filed: Aug. 31, 2004

(51) Int. Cl.
*H01Q 19/14* (2006.01)

(52) U.S. Cl. ..... 343/767; 343/771

(58) Field of Classification Search ..... 343/749, 343/767, 771, 772, 702, 700 MS
See application file for complete search history.

(56) References Cited

U.S. PATENT DOCUMENTS 3,732,572 A * 5/1973 Kuo ..... 343/792.5
6,400,327 B1 * 6/2002 Galvin ..... 343/749

OTHER PUBLICATIONS

N. Michishita and H. Arai, FDTD Analysis of Printed Monopole Antenna, 11th International Conf of Antennas and Propagation, Apr. 17-20, 2001, pp 728-731 Conf Publication No. 480, IEE 2001.
D. H. Schaubert et al., Moment Method Analysis of Infinite Stripline-Fed Tapered Slot Antenna Arrays with Ground Plane, IEEE Transactions on Antennas and propagation, pp 1161-1166, vol. 42, No. 8 Aug. 1994.

* cited by examiner

*Primary Examiner*—Shih-Chao Chen
*Assistant Examiner*—Jimmy Vu
(74) *Attorney, Agent, or Firm*—Allan Y. Lee; Michael A. Kagan; Peter A. Lipovsky

(57) ABSTRACT

An improved tapered slot antenna. The structure includes a first antenna element, a second antenna element, a brace, a semi-infinite balun and a radome. The first and second antenna elements are operatively coupled to the brace in a tapered slot antenna configuration. The first and second input feed of the semi-infinite balun are operatively coupled to the first and second antenna elements, respectively, so that the second input feed is situated along substantially an entire length of a feed channel of the second antenna element. The radome is operatively coupled to the first and second antenna elements. A method for fabricating improved tapered slot antennas is also described.

21 Claims, 13 Drawing Sheets

Side View

Side View

204

200
Side View

TAPERED SLOT ANTENNA

CROSS-REFERENCE TO RELATED APPLICATIONS

This application is related to U.S. patent application Ser. No.: 10/932,646, filed herewith, entitled "Concave Tapered Slot Antenna", by Rob Horner et al., Navy Case No. 96109, which is hereby incorporated by reference in its entirety herein for its teachings on antennas.

BACKGROUND OF THE INVENTION

The present invention is generally in the field of antennas.

Typical tapered slot antennas (TSAs) have limited bandwidth and power capabilities. Further, typical TSAs are relatively fragile and have large radar cross section (RCS).

A need exists for durable TSAs having broad bandwidth, high power capabilities and reduced RCS.

DETAILED DESCRIPTION OF THE INVENTION

The present invention is directed to Improved Tapered Slot Antennas. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely exemplary embodiments of the invention. To maintain brevity, other embodiments of the invention that use the principles of the present invention are not specifically described in the present application and are not specifically illustrated by the present drawings.

Definitions

The following definitions and acronyms are used herein:

Acronym(s):
TSA—Tapered Slot Antenna
RCS—Radar Cross Section
SIB—Semi-Infinite Balun
rf—radio frequency Definition(s):
Radar Cross Section—area of an object that will reflect an incoming radar signal back to an interrogator.

The improved TSA includes a radome and a semi-infinite balun. In addition, the improved TSA is configured using simplified TSA input matching. In one embodiment, the present improved TSA provides durability. In one embodiment, the improved TSA operates over a large bandwidth. In one embodiment, the improved TSA can operate at high power such as, for example, greater than 1000 watts. In one embodiment, the improved TSA provides reduced RCS. The improved TSA is particularly useful in military ships.

Figure 1:
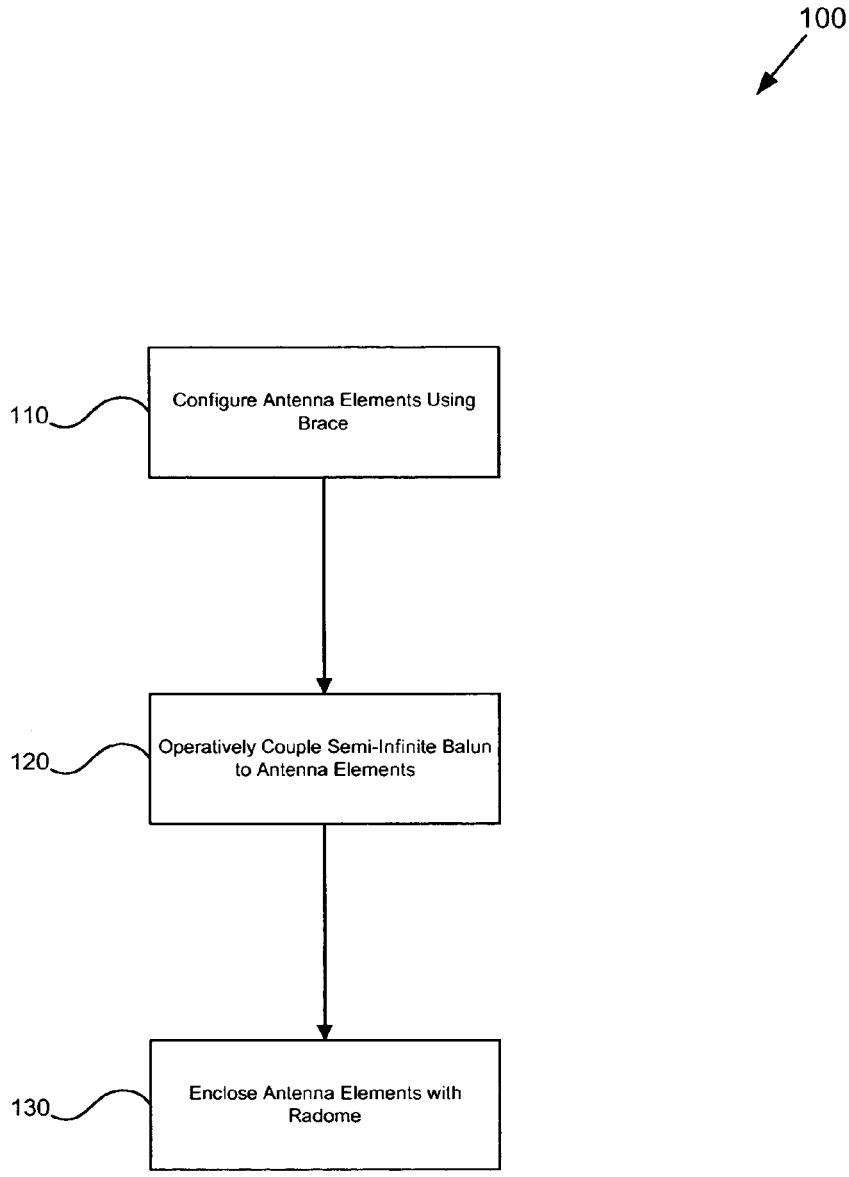
FIG. 1 is a flowchart of an exemplary method of manufacturing one embodiment of the invention.

FIG. 1 is a flowchart illustrating exemplary process steps taken to implement an embodiment of the invention. Certain details and features have been left out of flowchart 100 of FIG. 1 that are apparent to a person of ordinary skill in the art. For example, a step may consist of one or more sub-steps or may involve specialized equipment or materials, as known in the art. While STEPS 110 through 130 shown in flowchart 100 are sufficient to describe one embodiment of the present invention, other embodiments of the invention may utilize steps different from those shown in flowchart 100.

FIGS. 2A–2L are views of some of the features of an exemplary improved TSA in intermediate stages of fabrication, formed in accordance with one embodiment of the invention. These fabrication stages are described in greater detail below in relation to flowchart 100 of FIG. 1.

Figures 2A, 2B:
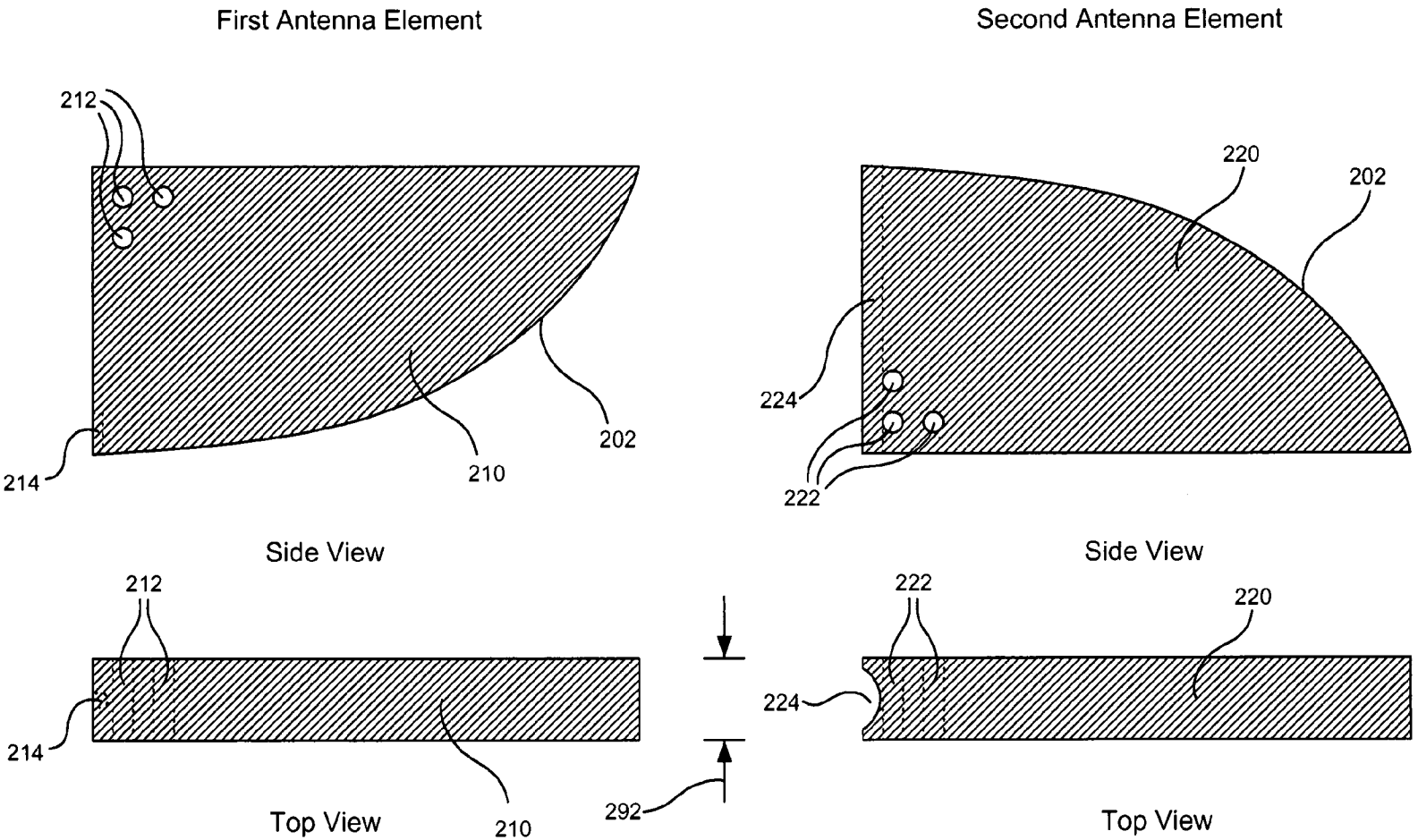
FIG. 2A is a side and top view of some of the features of an exemplary TSA formed in accordance with one embodiment of the invention.
FIG. 2B is a side and top view of some of the features of an exemplary TSA formed in accordance with one embodiment of the invention.

Referring to FIGS. 1 and 2A–2E, at STEP 110 in flowchart 100, the method configures first antenna element 210 and second antenna element 220 using brace 240. First and second antenna elements 210, 220 comprise a substantially conductive material such as, for example, stainless steel and aluminum. First and second antenna elements 210, 220 are capable of transmitting and receiving radio frequency (rf) energy. FIG. 2A is a top and side view of one embodiment of first antenna element 210. As shown in FIG. 2A, first antenna element 210 includes apertures 212 and feed aperture 214. In one embodiment, apertures 212 are threaded apertures. Apertures 212 are adapted to receive fasteners such as threaded screws and bolts. Feed aperture 214 is adapted to receive a first input feed such as an inner wire of a coaxial cable. In one embodiment, feed aperture 214 is operatively coupled to the first input feed by a bonding agent such as silver epoxy. FIG. 2B is a top and side view of one embodiment of second antenna element 220. As shown in FIG. 2B, second antenna element 220 includes apertures 222 and feed channel 224. In one embodiment, apertures 222 are threaded apertures. Apertures 222 are adapted to receive fasteners such as threaded screws and bolts. Feed channel 224 is adapted to receive a second input feed such as an outer wire of a coaxial cable. First and second antenna elements 210, 220 have a thickness equal to gap width 292, which is the gap width of the improved TSA as described in greater detail below with reference to FIG. 2E. First and second antenna elements 210, 220 have curvature 202. In one embodiment, curvature 202 can be represented by the following Equation 1:

$$Y(x)=a(e^{bx}-1); \quad \text{(Equation 1)}$$

where, a and b are parameters selected to produce a desired curvature. In one embodiment, parameters "a" and "b" are approximately equal to 0.2801 and 0.1028, respectively.

Figure 2C:
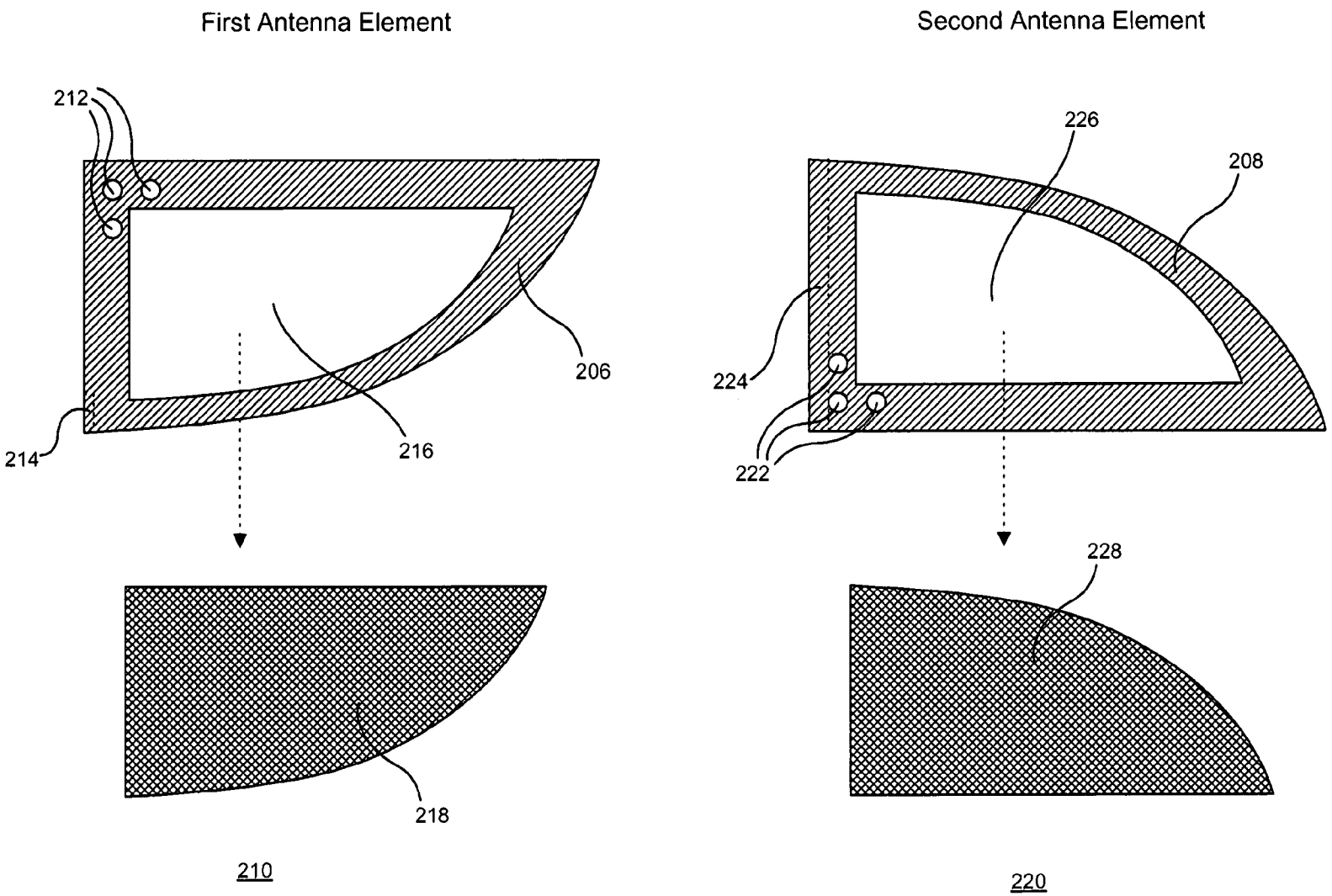
FIG. 2C is an exploded side view of some of the features of an exemplary TSA formed in accordance with one embodiment of the invention.

FIG. 2C is an exploded side view of one embodiment of first and second antenna elements 210, 220. The embodiment of FIG. 2C is also known as a reduced weight embodiment of first and second antenna elements 210, 220. First antenna element 210 includes first antenna element body 206 and a pair of thin covers 218. First antenna element body 206 has a gap width 292. Thin covers 218 are considerably thinner than gap width 292. The pair of thin covers 218 are operatively coupled to first antenna element body 206 so that weight reducing aperture 216 is covered on both sides of first antenna element 210. Thin covers 218 are operatively coupled to first antenna element body 206 by any convenient means such as, for example, bonding, fastening and welding. Similarly, second antenna element 220 includes second antenna element body 208 and a pair of thin covers 228. Second antenna element body 208 has a gap width 292. Thin covers 228 are considerably thinner than gap width 292. The pair of thin covers 228 are operatively coupled to second antenna element body 208 so that weight reducing aperture 226 is covered on both sides of second antenna element 220. Thin covers 228 are operatively coupled to second antenna element body 208 by any convenient means such as, for example, bonding, fastening and welding. Thin covers 218 and 228 can be substantially similar or identical components having different orientations when operatively coupled to first antenna element body 206 and second antenna element body 208, respectively.

Figure 2D:
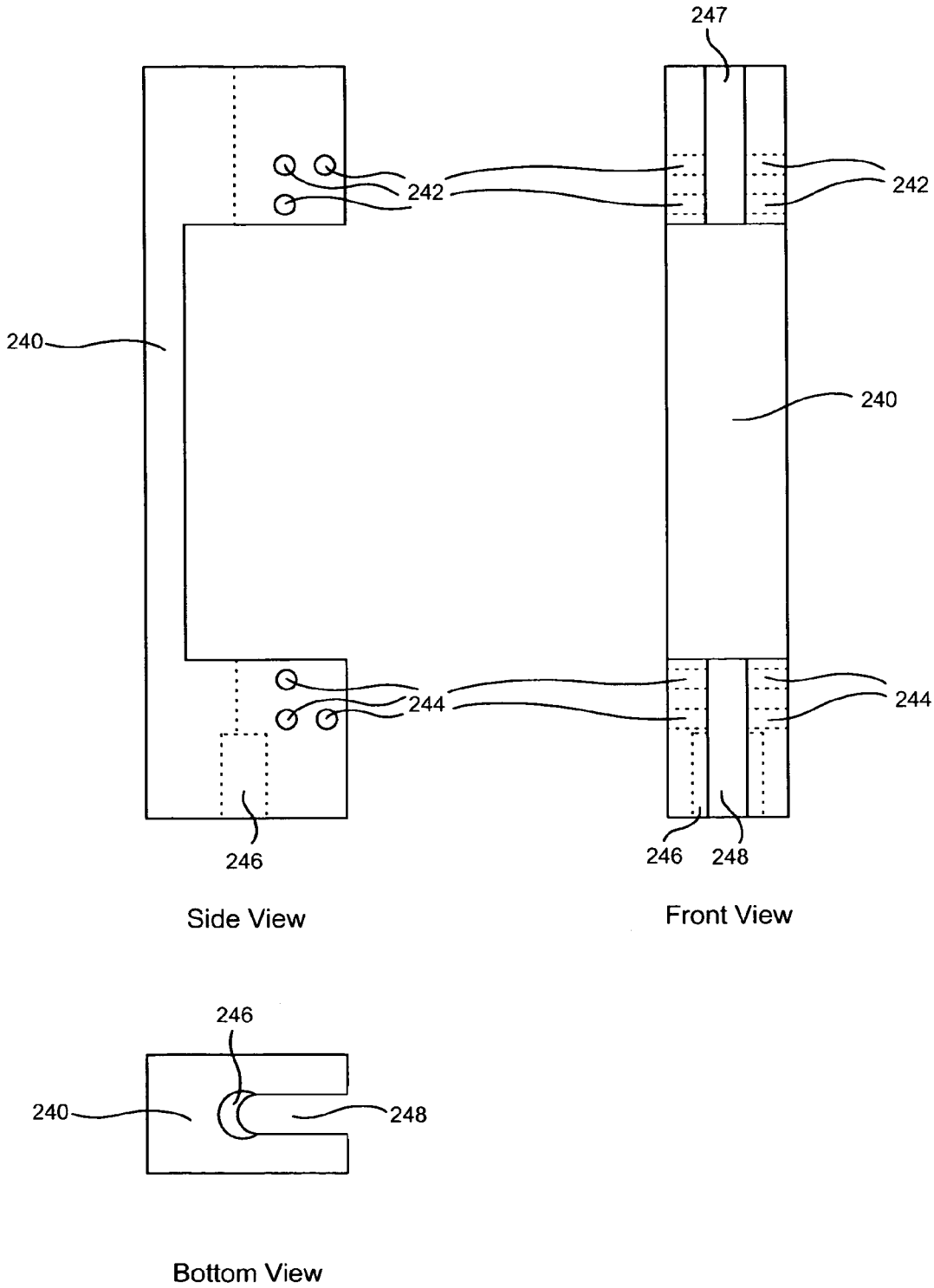
FIG. 2D is a side, front and bottom view of some of the features of an exemplary TSA formed in accordance with one embodiment of the invention.

FIG. 2D is a side, front and bottom view of one embodiment of brace 240. Brace 240 comprises a substantially nonconductive material such as, for example, plastic and G10. As shown in FIG. 2D, brace 240 includes slots 247, 248, apertures 242, 244 and receiver aperture 246. Slots 247, 248 are adapted to snugly receive first and second antenna elements 210, 220, respectively, in a tapered slot antenna configuration. Apertures 242, 244 are adapted to substantially align with apertures 212, 222, respectively, so that a fastener such as a threaded screw can operatively couple first and second antenna elements 210, 220 to brace 240. Apertures 242, 244 are adapted to decrease the width of slots 247, 248 when used in conjunction with fasteners such as nuts and bolts, and thus, first and second antenna elements 210, 220 can be securely coupled to brace 240 using slots 247, 248. In one embodiment, apertures 242, 244 are threaded apertures. Receiver aperture 246 is adapted to receive an input feed such as an outer wire of a coaxial cable.

Figure 2E:
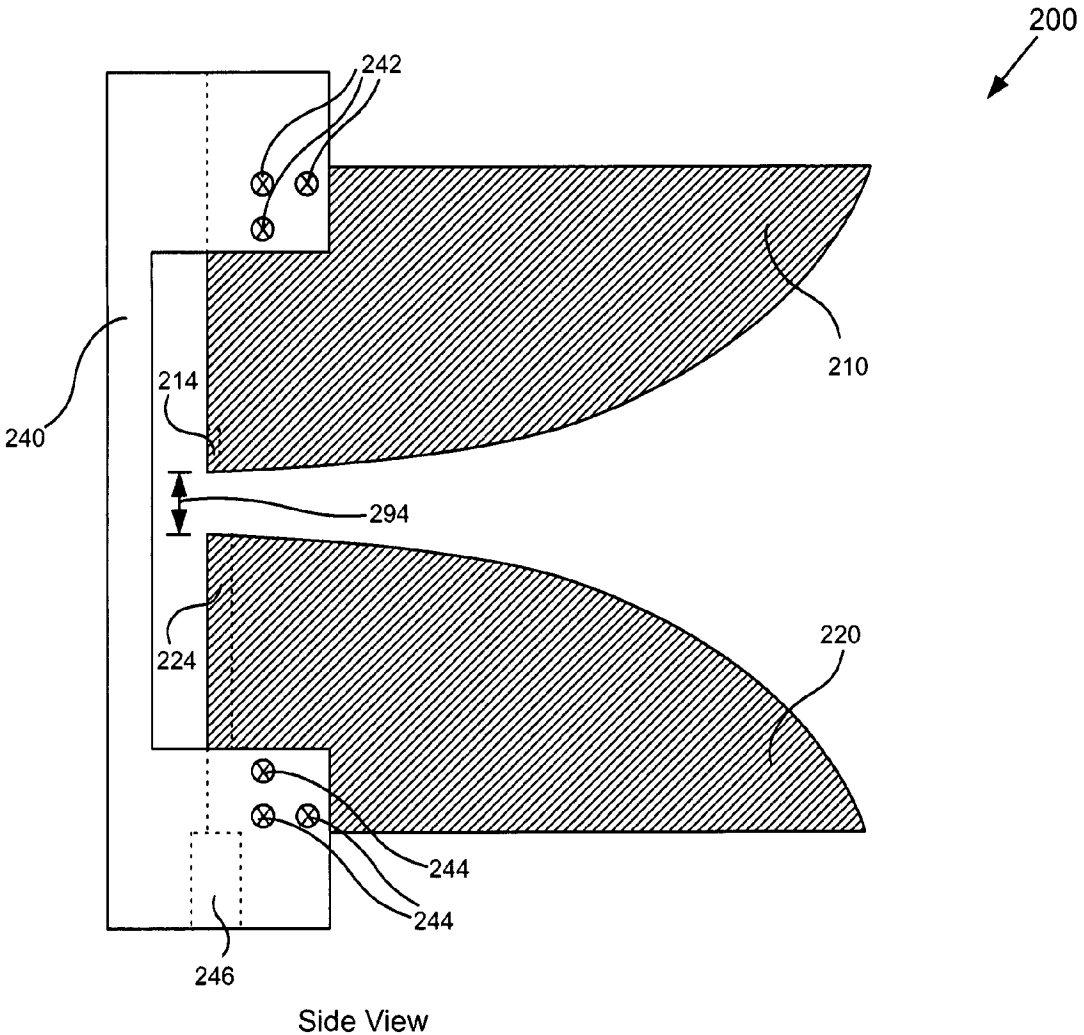
FIG. 2E is a side view of some of the features of an exemplary TSA formed in accordance with one embodiment of the invention.

FIG. 2E is a side view of one embodiment of improved TSA 200. As shown in FIG. 2E, first antenna element 210 is operatively coupled to brace 240 via fasteners (represented on FIG. 2E by the symbol "X") used in conjunction with apertures 242. Similarly, second antenna element 220 is operatively coupled to brace 240 via fasteners (represented on FIG. 2E by the symbol "X") used in conjunction with apertures 244. Improved TSA 200 has gap height 294. As previously described with reference to FIG. 2B, improved TSA 200 has gap width 292, which approximately equals the thickness of either of first and second antenna elements 210, 220. In accordance with the present invention, gap width 292 and gap height 294 are related in accordance to a simplified TSA input matching technique, which can be represented by the following Equation 2:

$$\frac{w}{h}=\frac{44\pi}{Z_0\sqrt{\varepsilon_r}}; \quad \text{(Equation 2)}$$

where, w=gap width h=gap height $Z_0$=characteristic impedance $\epsilon_r$=dielectric constant of dielectric spacing The simplified TSA input matching technique allows improved TSA 200 to match a predetermined impedance (e.g., 50 Ohms) over a broad frequency band. Thus, improved TSA 200 does not require a matching network. In one embodiment, gap width 292 is approximately equal to 0.375 inches and gap height 294 is approximately equal to 0.125 inches. After STEP 110, the method proceeds to STEP 120.

Referring to FIGS. 1 and 2F–2H, at STEP 120 in flowchart 100, the method operatively couples semi-infinite balun (SIB) 260 to first and second antenna elements 210, 220. In one embodiment, SIB 260 comprises a coaxial cable. Those skilled in the art shall recognize that input feeds other than coaxial cable can be used as a semi-infinite balun without departing from the scope or spirit of the improved TSA. For example, input feeds can comprise coupled stripline transformer and matching network feeds. In one embodiment, transmission power specifications for parts are considered when designing SIB 260. In one embodiment, STEP 120 comprises the following sub-steps:

i) mating SIB 260 to antenna elements 210, 220 and brace 240;

ii) applying an insulator between antenna elements 210, 220.

Figure 2F:
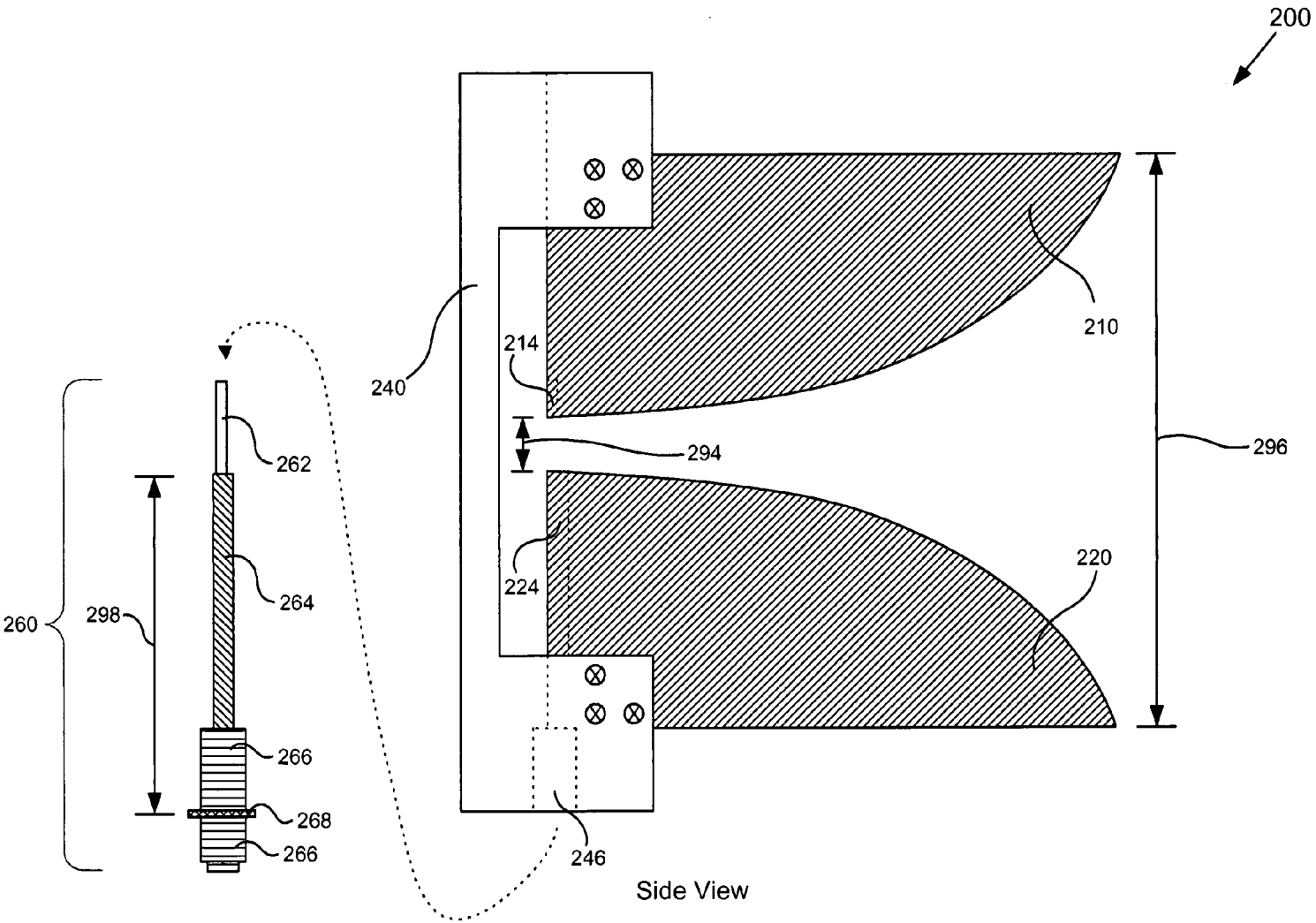
FIG. 2F is a side view of some of the features of an exemplary TSA formed in accordance with one embodiment of the invention.

FIG. 2F is an exploded side view of one embodiment of improved TSA 200. As shown in FIG. 2F, SIB 260 includes first input feed 262, second input feed 264, receiver 266 and stopper 268. First input feed 262 and second input feed 264 comprise conductive material such as metal. First input feed 262 and second input feed 264 are separated by an electrical insulator (not shown in FIGURES). Receiver 266 comprises conductive material such as metal. In one embodiment, receiver 266 comprises a connecting portion of outer coaxial cable. Stopper 268 allows SIB 260 to mate with other components in a predetermined configuration. SIB 260 is adapted to mate with feed aperture 214, feed channel 224 and receiver aperture 246. Specifically, first input feed 262 is adapted to mate with feed aperture 214; second input feed 264 is adapted to mate with feed channel 224; and receiver 266 is adapted to mate with receiver aperture 246. Second input feed 264 extends into receiver 266 and has length 298. Improved TSA 200 has TSA height 296. Length 298 is approximately greater than or equal to $$\frac{\lambda}{4}$$

of a lowest cutoff frequency of TSA 200, which is approximately equal to ½ of TSA height 296. An unexploded side view of SIB 260 mated with feed aperture 214, feed channel 224 and receiver aperture 246 is shown in FIG. 2G.

Figure 2G:
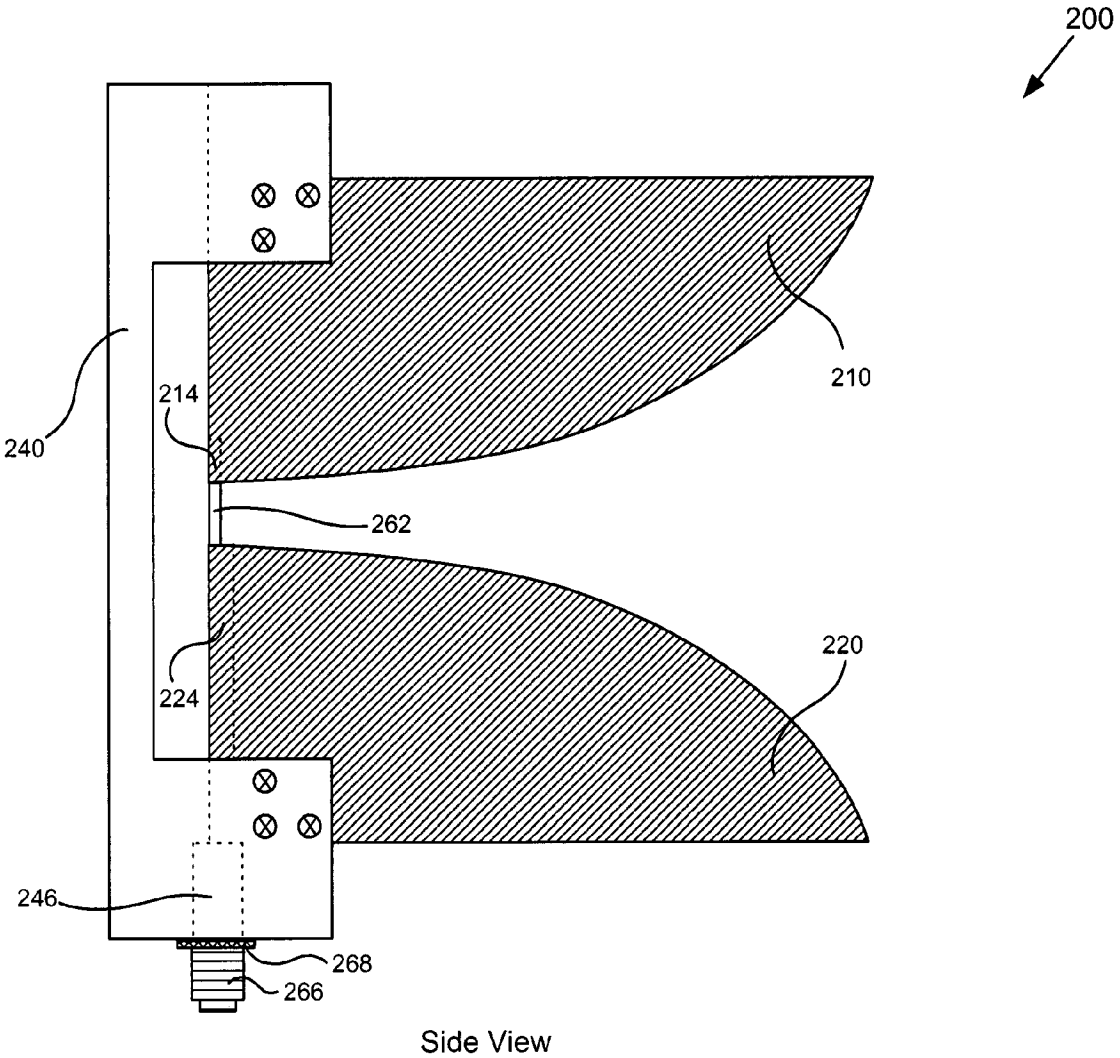
FIG. 2G is a side view of some of the features of an exemplary TSA formed in accordance with one embodiment of the invention.

FIG. 2G is a side view of one embodiment of improved TSA 200. As shown in FIG. 2G, first input feed 262 is mated with feed aperture 214. In accordance with the present invention, second input feed 264 (not shown in FIG. 2G) is mated with feed channel 224 so that second input feed 264 and feed channel 224 have approximately equal lengths and second input feed 264 is situated along substantially the entire length of feed channel 224. Situating second input feed 264 and feed channel 224 in this manner allows improved TSA 200 to operate over a broad bandwidth. Receiver 266 is mated with receiver aperture 246. In one embodiment, stopper 268 is situated flush against brace 240. Receiver 266 is capable of mating with an input feed such as a coaxial cable.

Figure 2H:
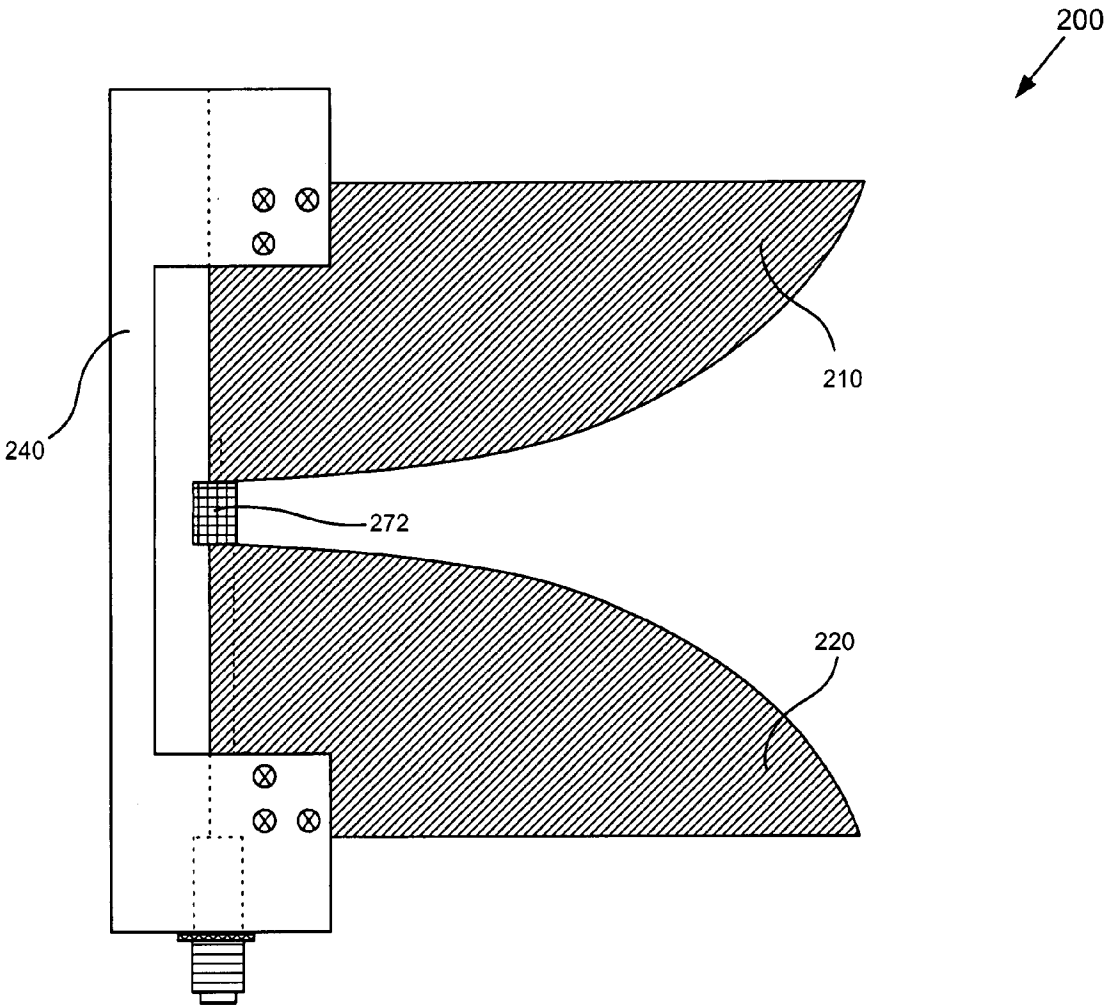
FIG. 2H is a side view of some of the features of an exemplary TSA formed in accordance with one embodiment of the invention.
Figure 2I:
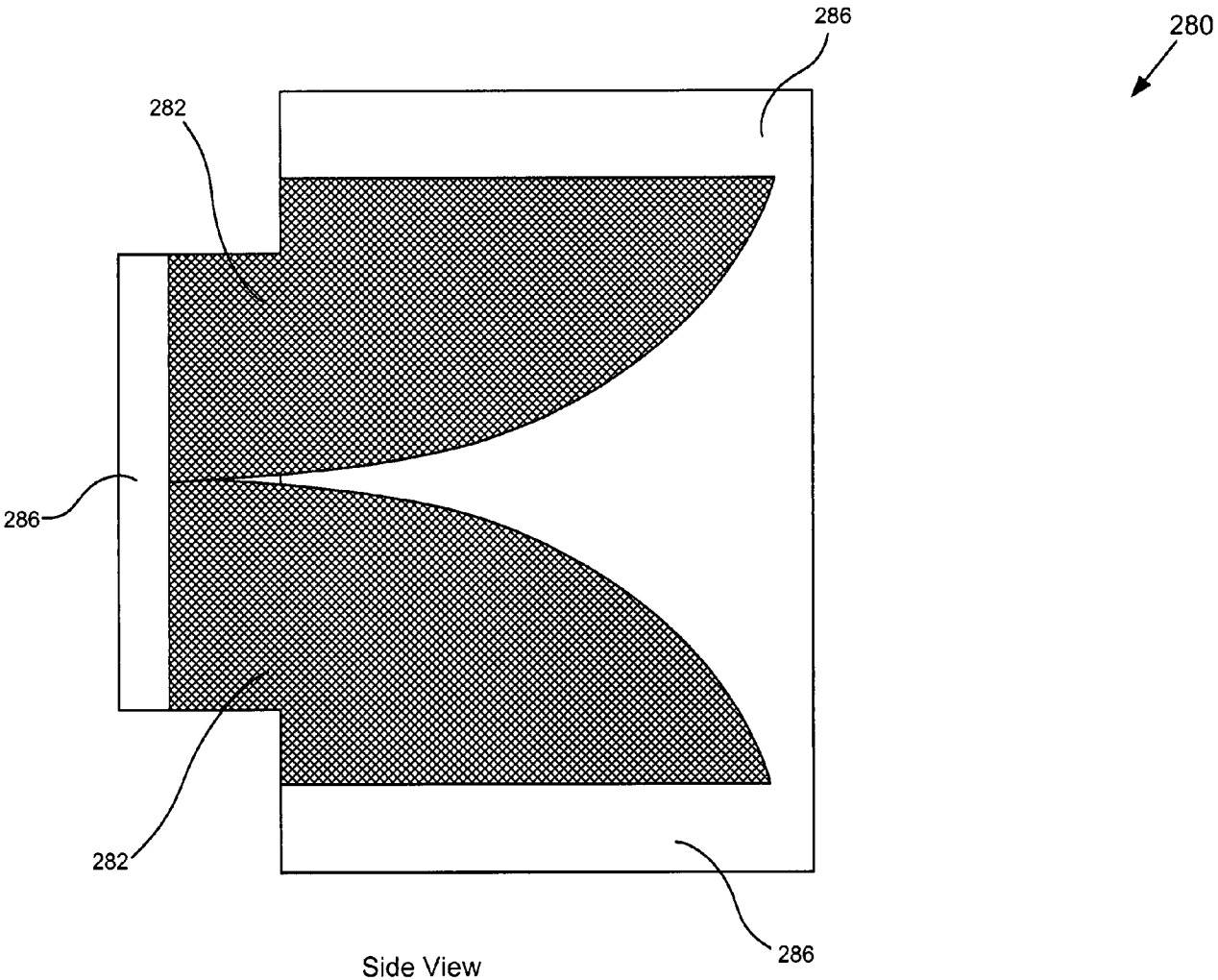
FIG. 2I is a side view of some of the features of an exemplary TSA formed in accordance with one embodiment of the invention.

FIG. 2H is a side view of one embodiment of improved TSA 200. As shown in FIG. 2G, portions of first input feed 262 situated between first and second antenna elements 210, 220 are covered by insulator 272. Insulator 272 helps prevent electrical arcing (i.e., conduction) between first and second antenna elements 210 and 220. After STEP 120, the method proceeds to STEP 130.

Figure 2J:
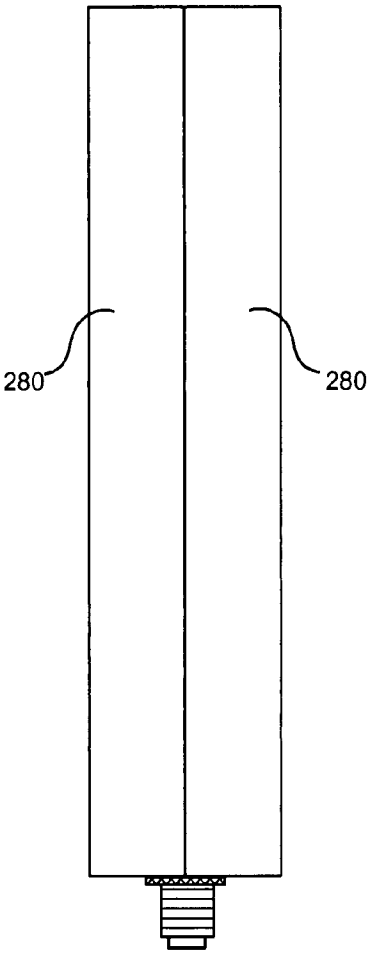
FIG. 2J is a side and front view of some of the features of an exemplary TSA formed in accordance with one embodiment of the invention.
Figure 2J:
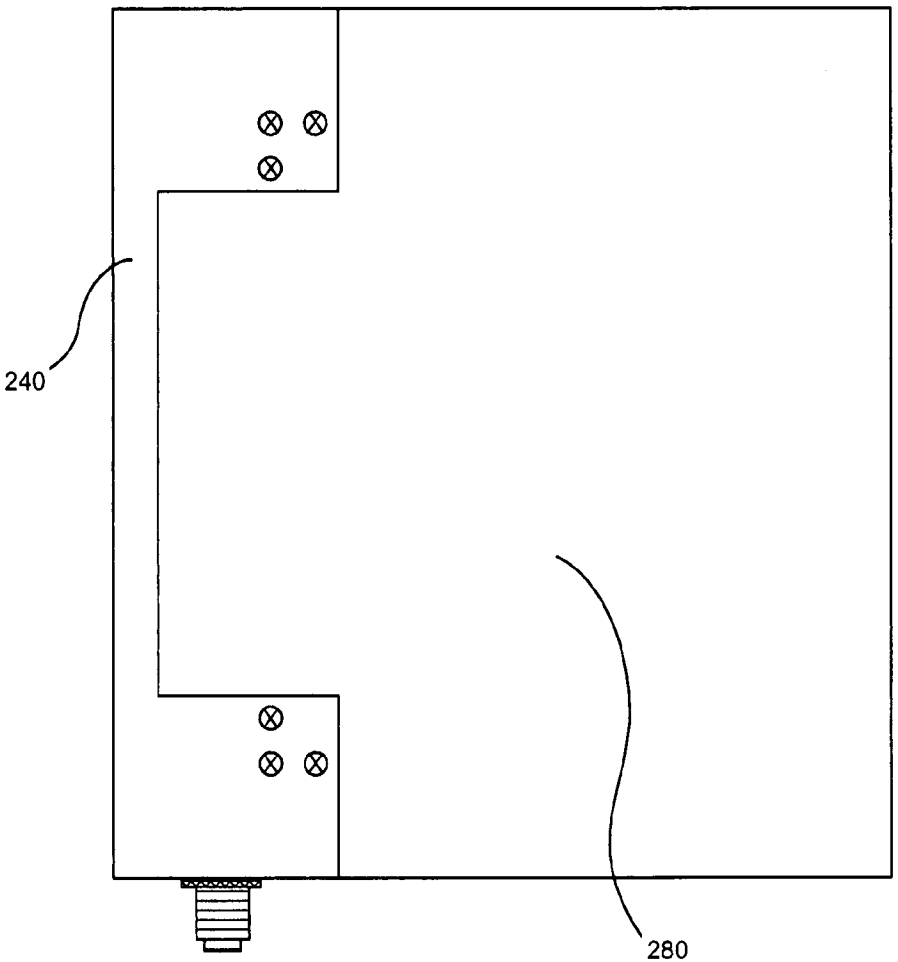
Figure 2K:
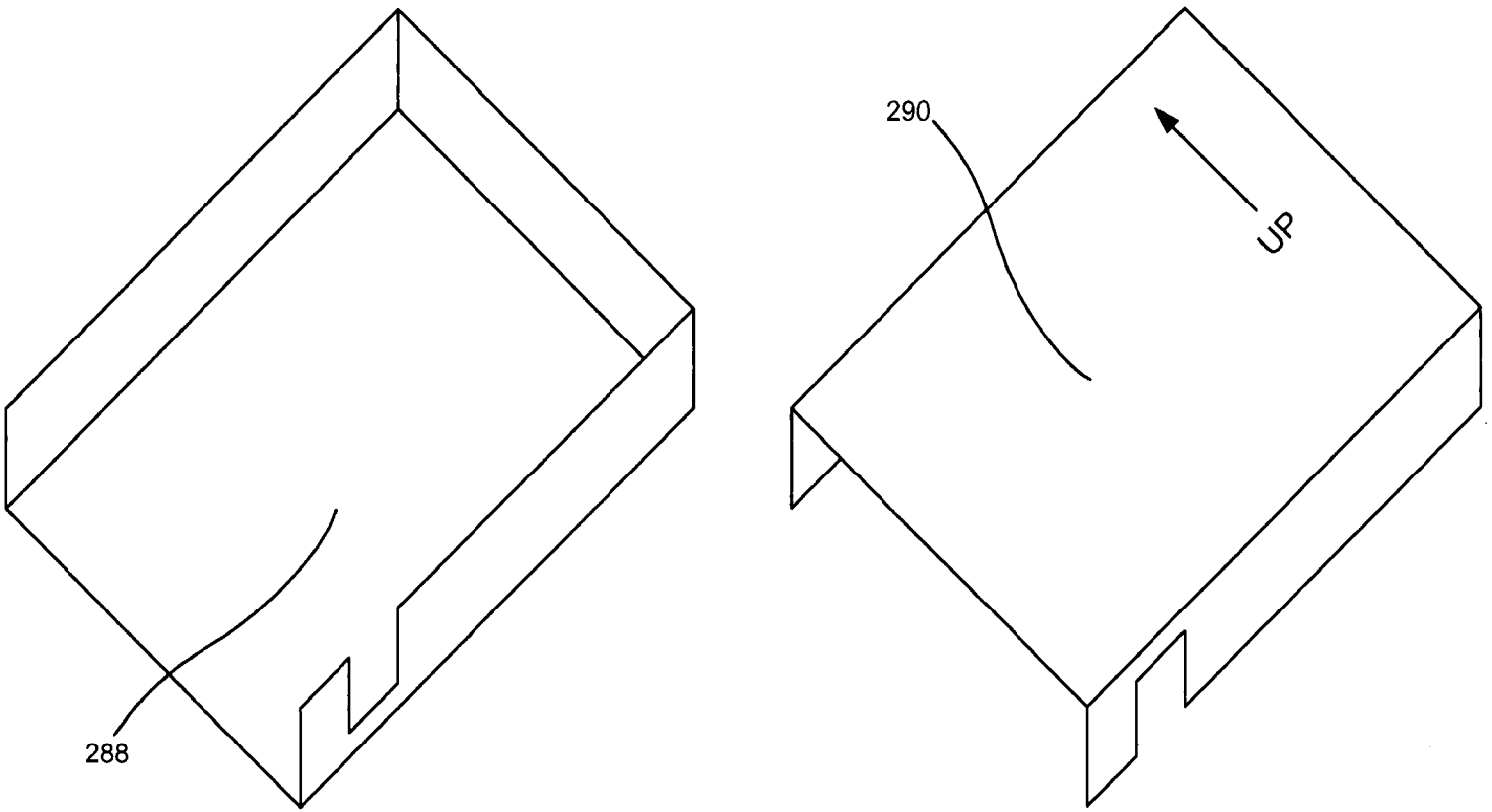
FIG. 2K is a perspective view of some of the features of an exemplary TSA formed 6 in accordance with one embodiment of the invention.
Figure 2L:
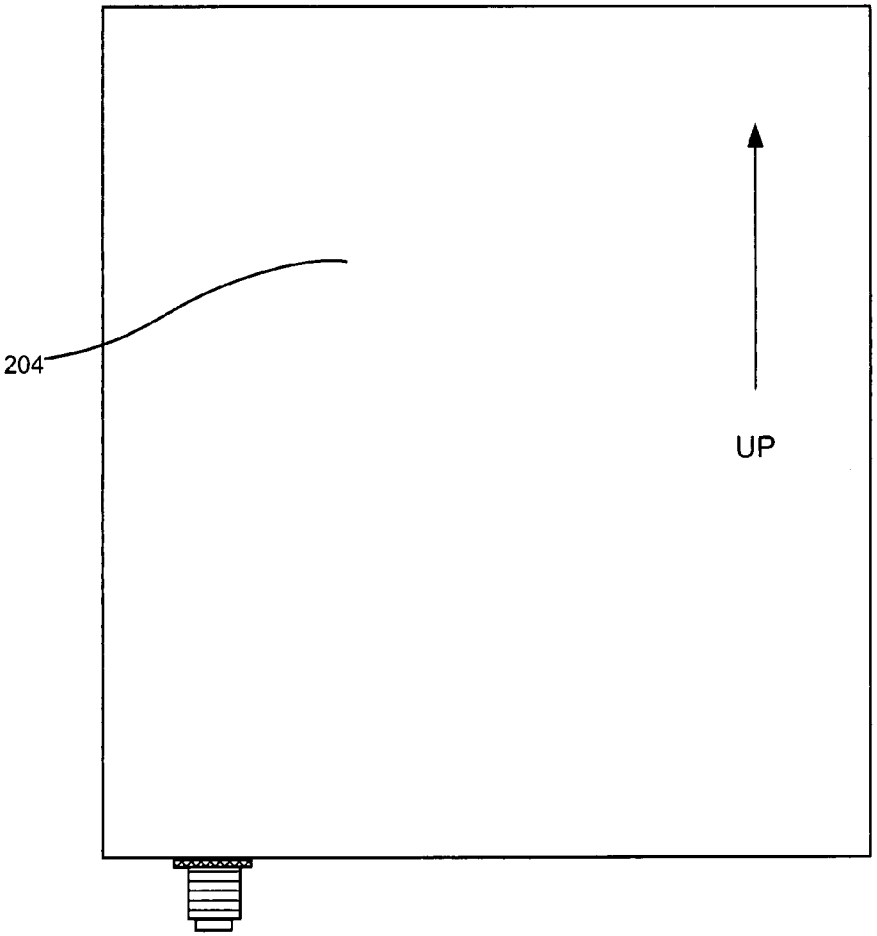
FIG. 2L is a side view of some of the features of an exemplary TSA formed in accordance with one embodiment of the invention.

Referring to FIGS. 1 and 21–2L, at STEP 130 in flowchart 100, the method encloses first and second antenna elements 210, 220 with a radome. In one embodiment, STEP 130 comprises the following sub-steps:

i) situating antenna elements between low-loss dielectric layers;

ii) encasing low-loss dielectric layers with a radome.

The low-loss dielectric layers help stabilize first and second antenna elements 210, 220 and brace 240. The radome helps stabilize the low-loss dielectric layers, and thus, helps stabilize brace 240 and first and second antenna elements 210, 220. Using low-loss dielectric layers in conjunction with the radome increases the durability of improved TSA 200. In one embodiment, sub-step (i) of STEP 130 comprises situating antenna elements between low-loss dielectric foam boards having cutouts (i.e., thinner cross-sectional height) in the shape of antenna elements. In one embodiment, sub-step (ii) of STEP 130 comprises encasing the low-loss dielectric layers with a radome by fastening means such as fiberglass pins and non-conductive screws or bolts. In one embodiment, sub-step (ii) of STEP 130 comprises the following sub-steps:

a) applying a bonding agent (e.g., epoxy) between low-loss dielectric layers and the radome;

b) applying pressure to the radome until the bonding agent sets.

In one embodiment, sub-step (b) of sub-step (ii) of STEP 130 comprises applying pressure via a clamp or a plurality of clamps. In one embodiment, sub-step (b) of sub-step (ii) of STEP 130 comprises applying pressure via a vacuum bag. For example, the radome can be sealed in a vacuum bag and then air can be vacuumed out to produce substantially uniform pressure to the radome. Once the bonding agent sets, the radome can be removed from the vacuum bag.

FIG. 21 is an interior side view of one embodiment of a low-loss dielectric layer such as dielectrics having $\epsilon_r<2$. Exemplary materials for low-loss dielectric layers include foam, honeycomb dielectric structures and air. As shown in FIG. 21, low-loss dielectric foam board 280 has cutouts 282 and interior side surface 286. Cutouts 282 have a thinner cross-sectional height than interior side surface 286. Cutouts 282 are adapted to snugly receive first and second antenna elements 210, 220. In one embodiment, low-loss dielectric foam board 280 is adapted to receive first and second antenna elements 210, 220 so that first and second antenna elements 210, 220 are substantially flush to interior side surface 286. In one embodiment, an exterior side of low-loss dielectric foam board 280 is adapted to receive brace 240 so that the exterior side of low-loss dielectric foam board 280 is substantially flush with brace 240.

FIG. 2J is a side and front view of one embodiment of improved TSA 200. FIG. 2J represents one embodiment of TSA 200 after first and second antenna elements 210, 220 are situated between a pair of low-loss dielectric foam boards 280. In one embodiment, brace 240 is substantially flush to the exterior sides of the pair of low-loss dielectric foam boards 280.

FIG. 2K is a perspective view of one embodiment of radome 204. Radome 204 comprises dielectric material is capable of substantially encapsulating. In one embodiment, radome 204 is capable of substantially sealing first and second antenna elements 210, 220, low-loss dielectric foam boards 280 and brace 240 from an external environment. In one embodiment, radome 204 is electrically transparent to all rf energy. In one embodiment, radome 204 is electrically transparent to a band of rf energy. In one embodiment, radome 204 comprises frequency selective surface material. In one embodiment, radome 204 comprises durable material. In one embodiment, radome 204 comprises fiberglass cloth with polyester resin. As shown in FIG. 2K, radome 204 includes interior radome housing 288 and exterior radome housing 290. Interior and exterior radome housings 288, 290 are adapted to mate so that interior radome housing 288 is situated snugly within exterior radome housing 290. Interior and exterior radome housings 288, 290 are adapted to partially encase brace 240 and enclose low-loss dielectric foam boards 280.

FIG. 2L is a side view of one embodiment of improved TSA 200. FIG. 2L represents one embodiment of TSA 200 after radome 204 is encased over low-loss dielectric foam boards 280. The method terminates at STEP 130.

Figure 3:
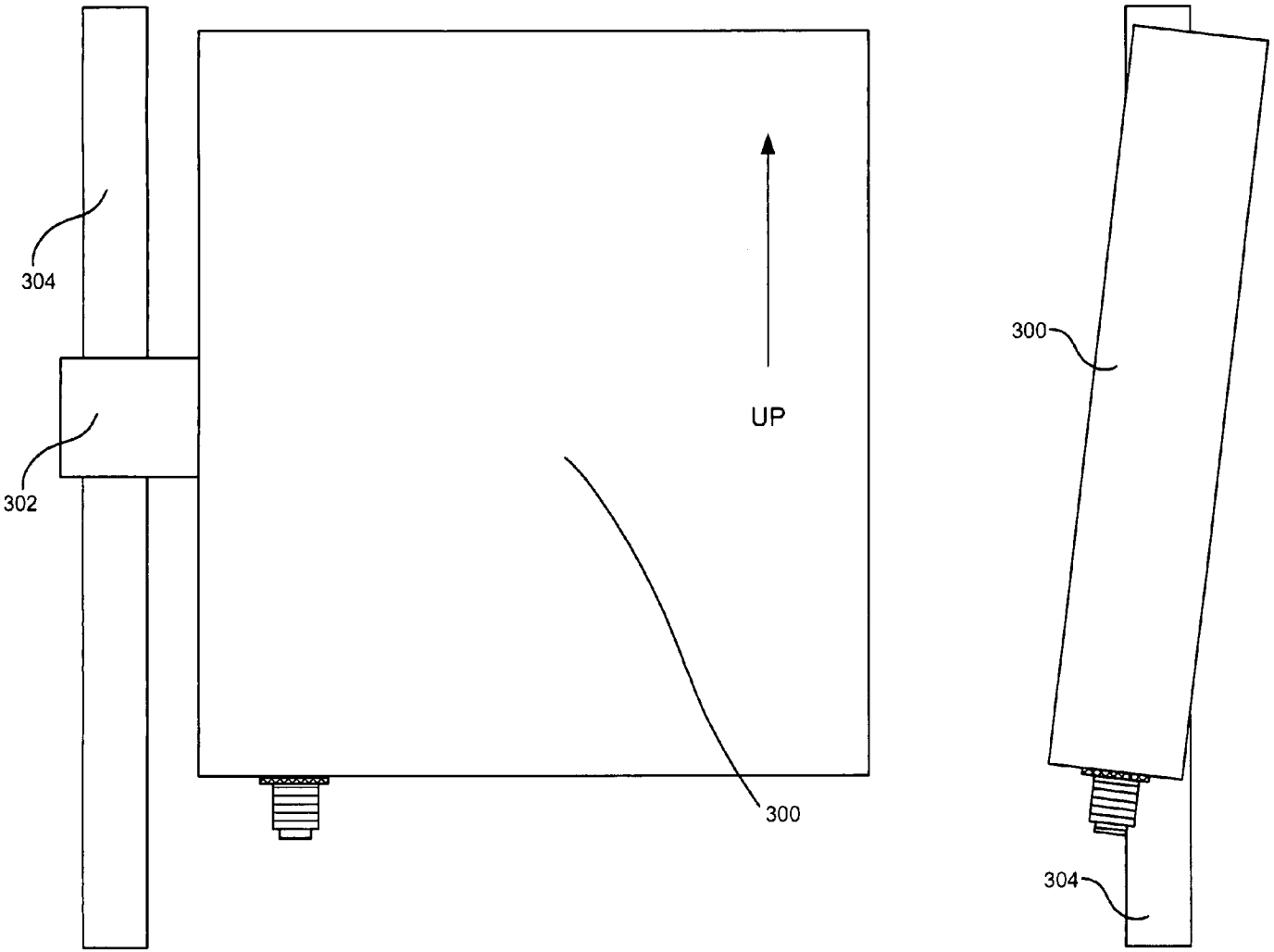
FIG. 3 is a side and front view of an exemplary implementation of one embodiment of the invention.

FIG. 3 is a side and front view of an exemplary implementation of one embodiment of an improved TSA. The exemplary implementation of FIG. 3 is also known as a reduced radar cross section signature implementation of an improved TSA. As shown in FIG. 3, mounting element 302 operatively couples improved TSA 300 to structure 304. In one embodiment, mounting element 302 is a mounting bracket. In one embodiment, structure 304 is a mast of a military ship that is approximately perpendicular to the deck of the ship. Also shown in the front view of FIG. 3, improved TSA 300 is angled at a small angle relative to structure 304. In one embodiment, improved TSA 300 is angled at a small angle relative to a vertical axis. In one embodiment, improved TSA 300 is angled at approximately 10 degrees relative to structure 304. In one embodiment, improved TSA 300 is angled at approximately 10 degrees relative to a vertical axis. Angling improved TSA 300 provides a reduced RCS signature due to the redirection of incoming signals (e.g., interrogating radar signals) to a vertical direction (either upward or downward depending upon which side the incoming signals originate). Angling improved TSA 300 only reduces vertically transmitted power by less than 2 percent (or approximately 1.52%) because the cosine of 10 degrees is approximately 0.9848.

From the above description of the invention, it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

We claim:

1. An improved tapered slot antenna, comprising:

a) a first antenna element capable of transmitting and receiving rf energy;

b) a second antenna element capable of transmitting and receiving rf energy;

c) a brace, operatively coupled to said first antenna element and said second antenna element, capable of snugly receiving said first antenna element and said second antenna element in a tapered slot antenna configuration, and having a gap height and gap width represented by the following equation:

$$\frac{w}{h} = \frac{44\pi}{Z_0\sqrt{\varepsilon_r}};$$

d) a semi-infinite balun comprising a first input feed and a second input feed, wherein said first input feed is operatively coupled to a feed aperture of said first antenna element, and wherein said second input feed is operatively coupled to a feed channel of said second antenna element so that said second input feed is situated along substantially an entire length of said feed channel;

e) a radome, operatively coupled to said first and second antenna elements, wherein said radome is capable of allowing at least one band of rf energy to pass through said radome, and wherein said radome substantially encloses and helps stabilize said first and second antenna elements.

2. The improved tapered slot antenna of claim 1, wherein said radome comprises:

a) at least one dielectric layer, operatively coupled to said first antenna element and said second antenna element, wherein said at least one dielectric layer substantially encloses and helps stabilize said first antenna element and said second antenna element;

b) a radome housing, operatively coupled to said first and second antenna elements, wherein said radome is capable of allowing at least one band of rf energy to pass through said radome, and wherein said radome housing helps stabilize said at least one dielectric layer.

3. The improved tapered slot antenna of claim 2, wherein said at least one dielectric layer comprise a pair of low-loss dielectric foam boards, wherein each low-loss dielectric foam board has cutouts adapted to receive first and second antenna elements so that said first and second antenna elements are substantially flush to an interior side surface of said low-loss dielectric foam board.

4. The improved tapered slot antenna of claim 1, wherein said first and second antenna elements comprise a substantially conductive material.

5. The improved tapered slot antenna of claim 1, wherein said first and second antenna elements each has a curvature according to the following equation:

$$Y(x)=a(e^{bx}-1).$$

6. The improved tapered slot antenna of claim 1, wherein said first and second antenna elements each comprise a pair of thin covers operatively coupled to an antenna element body having a weight reducing aperture.

7. The improved tapered slot antenna of claim 1, wherein said brace comprises a substantially nonconductive material.

8. The improved tapered slot antenna of claim 1, wherein said semi-infinite balun comprises a coaxial cable.

9. The improved tapered slot antenna of claim 1, wherein said radome comprises a frequency selective surface material.

10. The improved tapered slot antenna of claim 1, further comprising an insulator that substantially covers portions of said first input feed that are situated between said first and second antenna elements.

11. The improved tapered slot antenna of claim 1, wherein a reduced radar cross section signature embodiment comprises said improved tapered slot antenna coupled to a structure at a relatively small angle relative to a vertical axis.

12. A method for an improved tapered slot antenna, the method comprising the steps of:

a) configuring a first antenna element and a second antenna element in a TSA configuration using a brace so that a gap height and a gap width are represented by the following equation:

$$\frac{w}{h} = \frac{44\pi}{Z_0\sqrt{\varepsilon_r}};$$

b) coupling a first input feed and a second input feed of a SIB to a feed aperture of said first antenna element and a feed channel of said second antenna element, respectively, wherein said second input feed is situated along substantially an entire length of said feed channel;

c) enclosing said first antenna element and said second antenna element with a radome capable of allowing at least one band of rf energy to pass through said radome, and capable of helping to stabilize said first and second antenna elements.

13. The method of claim 12, wherein said first and second antenna elements each has a curvature according to the following equation:

$$Y(x)=a(e^{bx}-1).$$

14. The method of claim 12, wherein said coupling a first input feed and a second input feed STEP (b) comprises the following sub-steps:

i) mating said SIB to said first and second antenna elements and said brace;

ii) applying an insulator between said first and second antenna elements.

15. The method of claim 12, wherein said enclosing said first antenna element and said second antenna element with a radome STEP (c) comprises the following sub-steps:

i) situating said first and second antenna elements between a low-loss dielectric layer;

ii) encasing said low-loss dielectric layer with a radome.

16. The method of claim 15, wherein said situating said first and second antenna elements STEP (i) comprises situating said first and second antenna elements between low-loss dielectric foam boards having cutouts in the shape of said first and second antenna elements.

17. The method of claim 15, wherein said situating said first and second antenna elements STEP (i) comprises situating said first and second antenna elements between low-loss dielectric foam boards having cutouts adapted to receive first and second antenna elements so that said first and second antenna elements are substantially flush to an interior side surface of said low-loss dielectric foam board.

18. The method of claim 15, wherein said encasing said low-loss dielectric layer with a radome STEP (ii) comprises the following sub-steps:

(a) applying a bonding agent between said low-loss dielectric layer and said radome;

(b) applying pressure to said radome until said bonding agent sets.

19. The method of claim 12, wherein said method further comprises a step of coupling said tapered slot antenna to a structure at a relatively small angle relative to a vertical axis to form a reduced radar cross section signature embodiment.

20. An improved tapered slot antenna, comprising:

a) means for configuring a first antenna element and a second antenna element in a TSA configuration using a brace so that a gap height and a gap width are represented by the following equation:

$$\frac{w}{h} = \frac{44\pi}{Z_0\sqrt{\varepsilon_r}};$$

b) means, operatively coupled and responsive to said means for configuring a first antenna element and a second antenna element, for coupling a first input feed and a second input feed of a SIB to a feed aperture of said first antenna element and a feed channel of said second antenna element, respectively, wherein said second input feed is situated along substantially an entire length of said feed channel;

c) means, operatively coupled and responsive to said means for coupling a first input feed and a second input feed of a SIB, for enclosing said first antenna element and said second antenna element with a radome capable of allowing at least one band of rf energy to pass through said radome, and capable of helping to stabilize said first and second antenna elements.

21. The improved tapered slot antenna of claim 20, wherein said means for enclosing said first antenna element and said second antenna element with a radome comprises:

i) means for situating said first and second antenna elements between a low-loss dielectric layer;

ii) means, operatively coupled and responsive to said means for situating said first and second antenna elements between a low-loss dielectric layer, for encasing said low-loss dielectric layer with a radome.

* * * * *

UNITED STATES PATENT AND TRADEMARK OFFICE

CERTIFICATE OF CORRECTION

PATENT NO. : 7,009,572 B1
APPLICATION NO. : 10/932650
DATED : March 7, 2006
INVENTOR(S) : Robert S. Horner and Bruce Calder It is certified that error appears in the above-identified patent and that said Letters Patent is hereby corrected as shown below:

On the Title Page Item (75) Inventor Robert S. Horner's name is incorrectly listed as Robert S. Homer on the title page.

Should read,

Robert S. Horner

Signed and Sealed this

Eighteenth Day of August, 2009

David J. Kappos

David J. Kappos
*Director of the United States Patent and Trademark Office*